US005775446A

United States Patent [19]

Lott

[11] Patent Number: 5,775,446

[45] Date of Patent: Jul. 7, 1998

[54] NOZZLE INSERT FOR ROTARY ROCK BIT

[75] Inventor: W. Gerald Lott, Houston, Tex.

[73] Assignee: Nozzle Technology, Inc.

[21] Appl. No.: 675,717

[22] Filed: Jul. 3, 1996

[51] Int. Cl.[6] ..... E21B 10/18

[52] U.S. Cl. ..... 175/424; 239/489; 239/601

[58] Field of Search ..... 175/340, 393, 175/64, 424; 239/487, 489, 557, 590.5, 601

[56] References Cited

U.S. PATENT DOCUMENTS

| | | | |
|---|---|---|---|
| 3,275,248 | 9/1966 | O'Brien et al. | 239/489 X |
| 4,687,066 | 8/1987 | Evans | 175/340 |
| 5,494,124 | 2/1996 | Dove et al. | 175/424 |
| 5,495,903 | 3/1996 | Griffin et al. | 175/424 |
| 5,632,349 | 5/1997 | Dove et al. | 175/424 |

*Primary Examiner*—David J. Bagnell
*Attorney, Agent, or Firm*—Bush, Riddle & Jackson

[57] ABSTRACT

A nozzle insert for a rotary rock bit has an orifice with a generally circular central region and a plurality of angularly spaced, non-circular outer regions around the periphery thereof so that flow of mud through each outer region develops a vortex pattern that increases entrainment of rock particles to prevent bit balling, and decreases overbalance pressure to enhance rate of penetration.

2 Claims, 1 Drawing Sheet

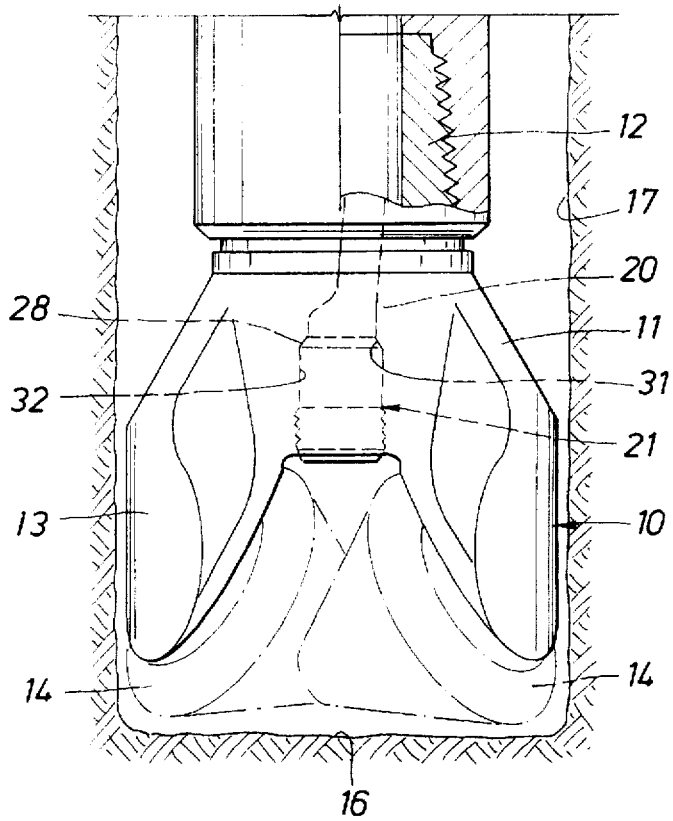
FIG. 1
FIG. 2
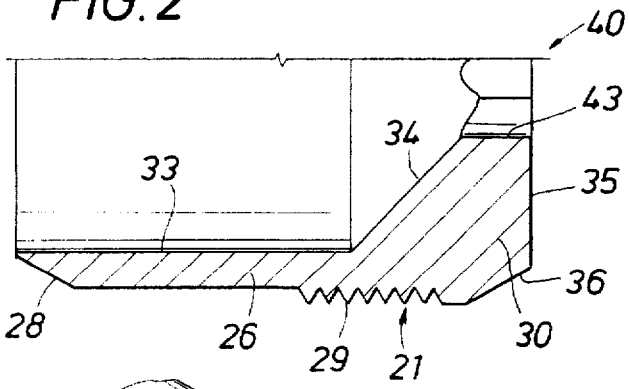
FIG. 3
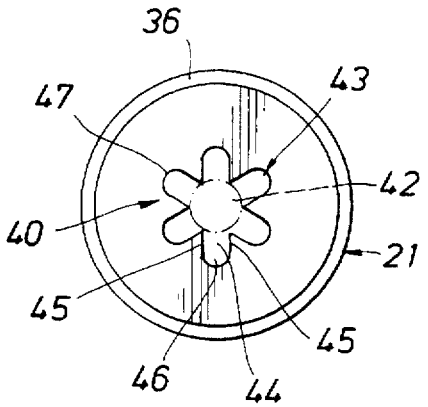
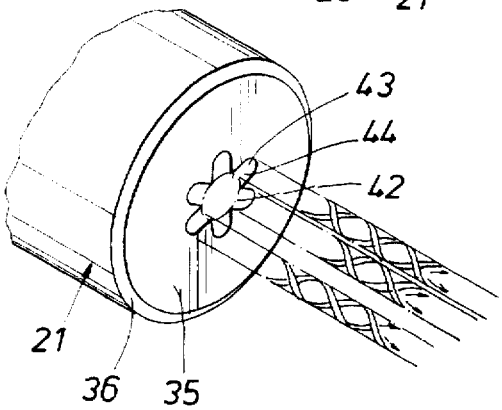
FIG. 4
FIG. 5
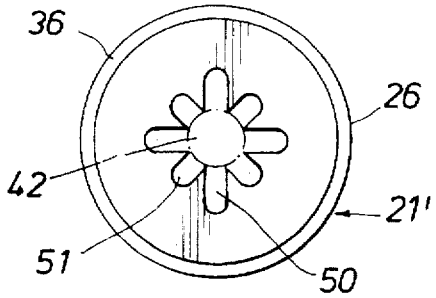

NOZZLE INSERT FOR ROTARY ROCK BIT

FIELD OF THE INVENTION

This invention relates generally to a new and improved nozzle structure for a rotary rock bit, and specifically to a drill bit having nozzle inserts which develop vortexes and strong turbulent shear layers in the mud flow at the bit/formation interface to provide rapid mixing and entrainment of cuttings.

BACKGROUND OF THE INVENTION

When using a rolling cone or a PCD rotary bit to drill a borehole into the earth, drilling fluid or "mud" is pumped down the drill string and out into the bottom of borehole through nozzles or jets where the fluid lubricates and cools the bit, and carries cuttings up through the annulus to the surface where they are separated out before the mud is re-circulated down the drill string. The nozzles are directed downward toward the interface where the rock is being chipped or scraped away so that the mud flow cleans the teeth or inserts and flushes the cuttings away. If the cleaning action is not as it should be, the rate of penetration of the bit through the rock is reduced due to "balling", a situation where cuttings adhere to and accumulate above the cutters and around the bit body to further impede their removal. In this case the rock particles can begin to recirculate at the interface and be ground up into an even finer particle sizes which will increase the mud's viscosity and impede the rate of penetration. Such regrinding produces undesirable fines that also increase the wear of the bit.

When a drill bit balls up and fails to provide a desired rate of penetration, the cause generally is related to inadequate hydraulic power at the drilling interface so that the cuttings are not rapidly displaced and entrained in the annulus flow stream. Such hydraulic power is influenced primarily by mud viscosity and density, and annular velocity. In selecting a bit to drill through a given downhole lithology, nozzle size and its distance from the hole bottom can be used to determine near-bit jetting action and intensity. Most of the commercially available drill bits known to applicant use circular orifices having a flow area that is selected in view of bit diameter, mud weight, hole conditions and drilling depth. Geometry of the nozzle orifice to improve entrainment and the efficient use of hydraulic power has, for the most part, been ignored. Although U.S. Pat. No. 4,687,066 issued Aug. 18, 1987 discloses helical grooves to promote swirling of the drilling mud as it exits a nozzle insert in order to create a divergent, large vortex which sweeps the interface laterally, no significant improvement in entrainment of rock particles is believed to occur. Moreover, the offsetting of flow passages to produce helical swirl causes pressure losses that reduce kinetic energy.

A general object of the present invention is to provide a new and improved rotary drill bit having a nozzle whose geometry produces a flow pattern which provides for a more efficient use of hydraulic energy.

Another object is to provide a new and improved bit of the type described having superior cleaning action and entrainment of cuttings to thereby minimize bit balling.

Still another object of the present invention is to provide a new and improved rotary drill bit with insert nozzles that are each shaped and arranged to develop coherent vortices which create strong turbulent shear layers in the mud flow at the bit/formation interface.

SUMMARY OF THE INVENTION

These and other objects are attained in accordance with the present invention through the provision of a rotary drill bit including a body having, for example, legs which journal rolling cone cutters that drill a borehole through rock when the body is turned under weight by a drill string or downhole motor. Drilling fluid or mud that is pumped downward through the drill string flows through passages between the legs and out into the bottom of the borehole through nozzle inserts that create jetting actions to entrain rock chips and cuttings in the fluids as the drilling proceeds. Each nozzle insert is in the form of a generally tubular member which is fixed in a bore near the lower end of a passage. To provide for enhanced use of hydraulic energy and a superior cleaning action, each nozzle insert has a conical throat in its lower end wall that leads to a central opening having a plurality of angularly spaced, radially arranged flow slots each having opposite side walls and a semicircular outer wall. The semi-elliptical shape of each flow slot, which has a low aspect ratio, generates a coherent vortex flow stream. The overall geometry produces a pressure profile of varying pressure differentials in the downstream flowfield. One effect is a reduction in the hydrostatic head pressure at the drilling interface which reduces the overbalance and thus the compression stress in the rock, which substantially increases the rate of penetration of the bit. The vortex flows also enhance the rapid entrainment of drill cuttings that are released by the cutter elements, which provides improved bottom hole cleaning and a substantial reduction in bit balling.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

FIG. 1 is a generalized view of a drill bit having typical rolling cone cutter elements thereon;

FIG. 2 is an enlarged quarter-sectional view of a nozzle insert structure in accordance with the present invention;

FIG. 3 is a bottom view of the nozzle structure of FIG. 2;

FIG. 4 is a schematic isometric view of the nozzle structure and the pattern of drilling fluid flow that emanates therefrom; and FIG. 5 is a view similar to FIG. 3 showing an alternative embodiment of the nozzle structure of this invention.

DETAILED DESCRIPTION OF A PREFERRED EMBODIMENT

As shown in FIG. 1, a drill bit 10 includes a body 11 having a threaded pin 12 on its upper end by which the body is connected to a box on the lower end of a tubular drill string. The drill string extends upward to the surface where it is turned by a powered rotary table in order to cause the bit 10 to turn and drill under a part of the weight of the drill string. The body 10 has depending legs 13 that carry inwardly projecting journal pins on which conical, rotary cutter elements 14 are mounted. Each cutter element 14 has rows of teeth that progressively chip away small fragments of the rock from the bottom face 16 of the borehole 17 as the bit 10 is turned. Drilling fluid or "mud" is pumped under pressure down through the drill string and through passages 20 in the body 11 which lead to respective nozzle inserts 21 that face downward. Each insert 21 defines a restrictive flow area so that the drilling fluid jets therefrom against the bottom face 16 of the borehole 17. Of course the borehole 17 is filled with drilling mud having a selected density that provides a hydrostatic head or pressure which overbalances the formation fluid pressure of any depth to prevent formation fluids from entering the borehole 17 and causing a disastrous blow-out at the surface. However the overbalance in favor of the borehole increases the compression stress and hardness of the rock at the interface 16, which significantly reduces the rate at which the bit 10 can penetrate the rock.

In order to enhance the removal of cuttings, prevent bit-balling, and thus enhance the rate of penetration of the bit 10, unique nozzle inserts 21 that are constructed in accordance with the invention are used. As shown in FIG. 2, each of the inserts 21 has a generally tubular body 26 with an inwardly inclined surface 28 at its upper end and a transverse wall 30 at its lower end. External threads 29 on the body 26 are meshed with companion threads in the lower portion of a cylindrical seating bore 32 to hold the insert 21 in place. The surface 28 engages an inclined surface 31 at the upper end of the bore 32, and diametrical slots (not shown) can be found in the outer end surfaces of the wall 30 to enable a suitable tool to be used to engage and tighten the threads 29. The insert body 26 has an internal cylindrical bore 33 that leads to a frusto-conical inner wall surface 34 that diverges toward an orifice or opening 40 to be described in detail below. A chamfered surface 36 can be formed around the outer front edge of the body 26.

As shown in FIGS. 2 and 3, the opening 40 which is formed centrally of the end wall 35 has a particular geometrical configuration. The convergent inner wall 34 leads to a circular central region 42 which is shown in dotted lines in FIG. 3. Extending radially outward of the region 42, in one embodiment, are a total of six semi-elliptical openings 43 spaced at 60°. Each radial opening or lobe 43 has an inner region 44 defined by parallel side walls 45, and an outer region 46 having a semicircular outer wall 47. Since the overall geometry of each radial opening 43 is non-circular, and can best be described as semi-elliptical with a low aspect ratio, the stream of mud emanating therefrom undergoes rotation that produces three-dimensional, axial and circumferential vortices which, in turn, induce large scale vortex flow patterns as shown in FIG. 4. A high level of entrainment of cuttings and granular rock material in the mud stream is achieved so that the risk of bit balling is considerably reduced. Each flow stream emanating from a semi-elliptical lobe 43 exhibits a negative pressure gradient toward its center, so that the pressure at the cutter rock interface 16 is substantially reduced to a near balanced condition. As a result, the compression stresses in the rock are reduced to enable the bit 10 to achieve a higher rate of penetration.

OPERATION

In operation and use of the present invention, the pin 12 on the bit 10 is threaded to a box on the lower end of the drill string and then the bit is lowered into the well bore 17 as joints or stands of the pipe are connected end-to-end. When the bit 10 is very near to the bottom, a kelley is connected as the uppermost joint of the string, which is adapted to be driven by the rotary table. Circulation is established by pumping mud down the drill string and out of each of the inserts 21 in the bit 10, where the mud returns to the surface via the annulus. The bit 10 is lowered to the bottom while turning the string to commence drilling, and a selected portion of the weight of the drill collars is slacked off and imposed upon it so that the teeth on each cutter element 14 chip away at the rock as they roll around on the bottom surface 16 of the borehole. Where the bit 10 is a PCD type, the elements scrape the bottom of the borehole to disintegrate the rock.

The jet of mud that emanates from each of the nozzle inserts 21 may be considered as having two regions: a central region 42 where the flow cross-section is basically circular, and six angularly spaced regions or lobes 43 that initially are substantially semi-elliptical as defined by the parallel side walls 45 and the semicircular outer end walls 47. Since the mud flow velocity in each region 43 is three-dimensional, vortexes are formed as shown generally in FIG. 4 that provide much improved mixing and entrainment of the rock particles therewith. As the mud flows beyond the jets 40 and toward the interface 16, there is a reduction in pressure inside each of the rotating flow streams. These reductions in pressure are effective at the drilling interface 16 to substantially reduce the hydrostatic head pressure that otherwise would exist, to correspondingly reduce the compression stresses in the rock so that rate of penetration is increased. The hydrodynamics that is produced rapidly accelerates the mixing and entrainment of even the finest of rock particles and debris, which are swept upwardly into the annulus. Thus the tendency of the bit 10 to ball up is greatly reduced, and the rate of penetration is increased.

An alternative embodiment of a nozzle opening shaped in accordance with the present invention is shown in FIG. 5. Here alternating lobes 50 have a greater radial dimension than the other lobes 51 to provide two sets of aspect ratios, each of which will generate an entrainment action that is improved over that of other shapes such as triangular, rectangular or square. Other configurations also could be used, such as pairs of angularly shaped, lesser radius lobes separated by a greater radius lobe.

It now will be recognized that a new and improved nozzle for a rotary drill bit has been disclosed which enables an increase in the rate of penetration, and in the overall efficiency of the drilling process. Since certain changes and modifications may be made in the disclosed embodiments without departing from the inventive concepts involved, it is the aim of the appended claims to cover all such changes and modifications that fall within the true spirit and scope of the present invention.

What is claimed is:

1. A nozzle insert for a rotary drill bit comprising: a generally cylindrical body having a lower end wall; orifice means opening through said end wall and having a generally circular central region and a plurality of angularly spaced, non-circular outer regions around the periphery of said central region, so that flow through each of said outer regions develops a vortex flow pattern to increase the entrainment of rock particles and to enhance the rate of penetration, each of said outer regions having a generally semi-elliptical shape provided by spaced-apart, parallel side walls having outer ends that are joined by a semi-circular end wall, and alternating ones of said outer regions having side walls that are longer than the side walls of the other of said regions.

2. A rotary rock bit, comprising: a body having means thereon for drilling a borehole in response to rotation of said body, said body having a plurality of angularly spaced downwardly opening cylindrical bores formed therein; and nozzle insert means fixed in each of said bores, each of said insert means having orifice means defining a generally circular central region and a plurality of angularly spaced, non-circular outer regions around the periphery of said central region, so that flow of drilling fluid through each of said outer regions develops a vortex flow pattern to increase the entrainment of rock particles in said flow and to enhance the rate of penetration, each of said outer regions having a generally semi-elliptical shape provided by spaced-apart, parallel side walls having outer ends that are joined by a semi-circular end wall, and said side walls of alternating ones of said outer regions are longer than the side walls of the other of said regions.

* * * * *